US005213871A

United States Patent [19]

VanBortel et al.

[11] Patent Number: 5,213,871

[45] Date of Patent: May 25, 1993

[54] MOISTURE PROOF THERMALLY ACTUATED BINDING TAPE FOR BOOKS

[75] Inventors: David P. VanBortel, Walworth; Luke C. Lin, Rochester, both of N.Y.

[73] Assignee: Xerox Corporation, Stamford, Conn.

[21] Appl. No.: 848,466

[22] Filed: Mar. 9, 1992

[51] Int. Cl.[5] ..... B42D 1/00

[52] U.S. Cl. ..... 428/189; 428/344; 428/347; 428/349

[58] Field of Search ..... 428/349, 189, 344, 347

[56] References Cited

U.S. PATENT DOCUMENTS 5,006,396 4/1991 VanBortel et al. ..... 428/189

OTHER PUBLICATIONS

Webster's Ninth New Collegiate Dictionary; "hygroscopic"; Merriam-Webster Inc.; Springfield, Mass.; 1984; p. 591.

*Primary Examiner*—Jenna L. Davis

*Attorney, Agent, or Firm*—Frederick E. McMullen

[57] ABSTRACT

A moisture proof binding tape for edge binding pages to form a book consisting of a non-permeable temperature resistant foil layer covering one side of the backing strip forming a moisture barrier, a high temperature steam resistance adhesive between the foil layer and the backing strip to secure the foil layer to the backing strip, and a relatively thick central stripe of high tack heat activated adhesive flanked by relatively thin side stripes of low tack heat activated adhesive on the foil layer, the central adhesive stripe comprising a non-hygroscopic adhesive.

5 Claims, 1 Drawing Sheet

MOISTURE PROOF THERMALLY ACTUATED BINDING TAPE FOR BOOKS

The invention relates to a binding tape for adhesively binding pages together to form a 'Perfect Bound' book or pamphlet, and more particularly, to an improved moisture proof thermally actuated binding tape using a non-hygroscopic spine adhesive.

As described in U.S. Pat. No. 5,006,396 to "Moisture Proof Thermally Actuated Binding Tape for Books", issued on Apr. 9, 1991, in the names of David P. VanBortel et al, the disclosure of which is herein incorporated by reference, a popular method of binding pages together permanently to form a 'Perfect Bound' book, pamphlet, or the like, uses a binding strip or tape with heat activated adhesive. As discussed more fully in the aforecited VanBortel et al patent, moisture tends to accumulate in the paper backing strip of the binding tape. During the binding process, when heat and pressure are applied, the moisture vaporizes to form steam. The steam rises into the adhesives in the form of bubbles. When the binding process is completed, the steam is trapped in the adhesive, resulting in a degraded and poor bind.

The VanBortel et al patent addressed this problem by placing an impervious moisture proof layer such as aluminum foil between the binding tape backing and the adhesives, thereby preventing any steam created through heating of the binding strip from passing upwardly from the backing strip into the strip adhesives. It has been found, however, that moisture may also accumulate in and thus be present in the adhesives themselves, particularly in the relatively thick spine adhesive. When this occurs, the moisture is turned to steam by heat from the binding process, forming bubbles in the adhesive. On cooling of the adhesive, following completion of the binding process, the bubbles remain, resulting in a weakened and unreliable binding.

The present invention obviates this problem by an improved moisture proof thermally actuated binding tape for application to the spine of a book to bind the pages together that comprise the book, the tape having a backing strip with at least one stripe of high tack hot melt adhesive on the tape and a layer of non-permeable moisture resistant barrier material between the backing strip and the adhesive stripe to prevent transfer of moisture in the form of steam from the backing strip to the adhesive stripe on application of heat to the tape, application of heat to the tape actuating the adhesive to form a bond between the tape and the book spine, in which the stripe of high tack hot melt adhesive comprises a substantially non-hygroscopic adhesive material to obviate the accumulation of moisture by the adhesive material and the generation of undesirable steam on application of heat to the tape during binding.

IN THE DRAWINGS

Figure 1:
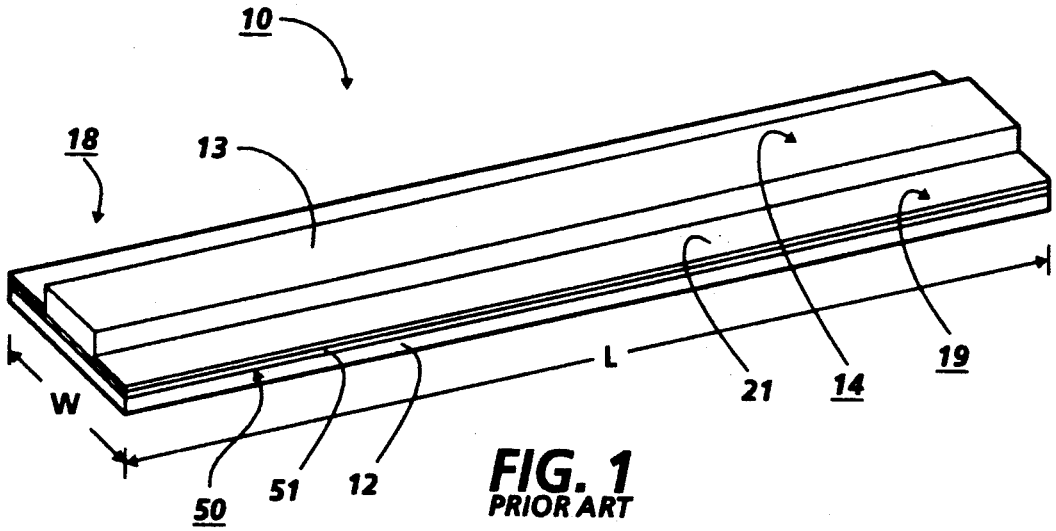
FIG. 1 PRIOR ART
FIG. 1 is an isometric view showing a prior art thermally actuated binding tape.
Figure 2:
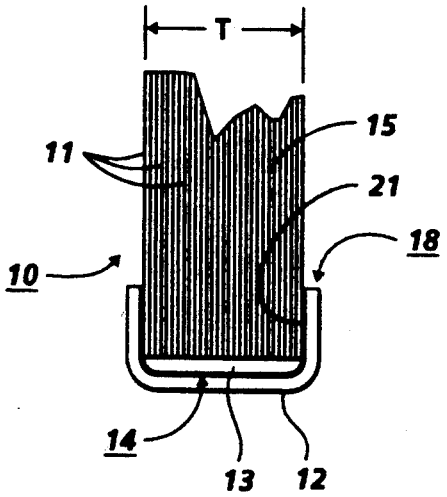
FIG. 2 PRIOR ART
FIG. 2 is a cross sectional view of the prior art binding tape shown in FIG. 1 applied to a book.

Referring to FIGS. 1 and 2 of the drawings, numeral 10 designates generally a binding tape of the type used to adhesively bind pages together to form a book. In the example shown, tape 10 comprises a length or strip 12 of formable backing or substrate material consisting of relatively heavy paper stock bearing heat activated adhesive coatings with a moisture barrier between the backing and the adhesives. Typically, tape 10 is in the form of a roll (not shown) that is cut to desired length at the time of use. Normally, the length L to which tape 10 is cut when binding is substantially equal to the length of the pages 11 of the book 15 being bound, although other lengths may be contemplated. The width W of the backing strip 12 is somewhat greater than thickness T of book 15 to allow the sides or flanks 18 of tape 10 to partially wrap around and be secured to the outer pages or covers of the assembled book 15 as will appear. Backing strip 12 may be of any desired thickness.

Backing strip 12 has a elongated stripe 14 of high tack heat activated hygroscopic adhesive 13 along the centerline thereof. Adhesive stripe 14 is relatively thick with a thickness of approximately 0.022 inches. The width of adhesive stripe 14 is less than the width W of backing strip 12 and approximates or is slightly greater than the thickness of the assembled pages 11 that when bound together form book 15. As a result, sides 18 of strip 12 extend along each side of stripe 14.

Sides 18 of backing strip 12 bear a relatively thin coating or layer of low tack heat activated hygroscopic adhesive 21. As a result, there is provided a stripe 19 of low tack heat activated adhesive 21 on each side of the central stripe 14 of high tack heat activated adhesive. The layer of adhesive 21 on sides 18 has a thickness of 0.0016 to 0.0020 inches.

A high tack adhesive such as spine adhesive 13 comprises an adhesive material or formulation which when heated remains highly viscous and somewhat immobile. High tack adhesives require application of a relatively large amount of heat with appropriate pressure in order to render the adhesive molten and wet-out the surface being adhered. A low tack adhesive such as adhesive 21 comprises an adhesive material or formulation requiring a relatively low amount of heat to make the adhesive molten or fluid and provide the necessary degree of surface wet-out with minimum application of pressure or heat.

In binding systems, and particularly in binding systems which comprise an integral part of a book making machine, such as the Xerox 5090 (Xerox and 5090 are registered Trademarks of Xerox Corporation, Stamford, CT), high speed binding is essential if high machine throughputs are to be achieved. To effect this and maintain the binding cycle as short as possible, relatively high binding temperatures on the order of 425° F. are used.

As discussed in the aforecited VanBortel et al patent, moisture that is present in tape 10 can interfere with and prevent obtaining a satisfactory and reliable binding. This occurs because moisture, during the thermal binding process, is converted to steam by the relatively high heat applied. Any steam created tends to bubble through the adhesive and escape to the atmosphere. Steam generated in the adhesive tends during the binding process to collect and form in relatively large bubbles which, due to the heat and pressure applied underneath during the binding process, passes upwardly through the adhesive. When, after the binding process is completed, the adhesive cools, the steam becomes trapped in the adhesive. This results in a poor quality binding with areas of poor adhesive contact, bumps, etc.

To overcome this problem, the aforecited VanBortel et al patent provided a moisture barrier 50 composed of a non-permeable, temperature resistant layer 51 between backing strip 12 and the adhesives 13, 21. Layer 51 for example comprised an aluminum foil of standard commercial thickness (i.e., 0.00035 inches). Layer 51 is retained in place on backing strip 12 by a suitable high temperature steam resistant adhesive.

While the addition of moisture barrier layer 51 effectively prevents the migration of steam due to moisture in backing strip 12 into the adhesives 13,21, it has been found that moisture, albeit less, can still be a problem, particularly in situations where the binding tape is stored for long periods of time, and/or exposed for any length of time to high humidity. Through testing and experimentation, it was found that over the typical period of time during which the binding tape was stored pending use that the moisture content of the hygroscopic adhesives 13,21 would rise to approximately 3% of the adhesives due to the absorption by the adhesives of moisture from the surrounding area and that it was the moisture absorbed by the relatively thick stripe of spine adhesive 13 that was the source of the steam. It was found that normally the relatively thin low tack adhesive 21 that comprised the side stripes 19 did not present a moisture problem since the amount of low tack adhesive is substantially less and the heat or thermal energy required to actuate this relatively small amount of low tack adhesive 21 was normally insufficient to vaporize whatever moisture was present in the adhesive 21.

However, in the case of the substantially thicker spine adhesive 13, the relatively large amount of thermal energy or heat required to activate the adhesive 13 vaporized the moisture that had accumulated in the adhesive 13 resulting in a poor bind. This was demonstrated by tests in which the binding tape 10 with moisture barrier layer 51 was allowed to saturate or equilibrate at high humidity, following which the tape was heated to typical binding temperatures. Bubbles believed to be steam from the liberation of water that had been absorbed by the spine adhesive 13 were observed. Since barrier layer 51 on substrate 12 precluded moisture in the backing tape from being the source of the bubbles, it was concluded that the bubbles originated in the spine adhesive 13

Figure 3:
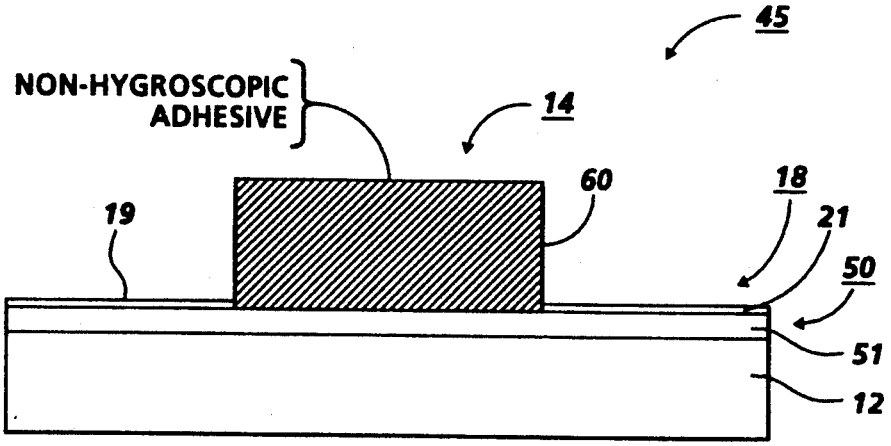
FIG. 3 is a cross sectional view of the improved moisture proof thermally actuated binding tape of the present invention in which the spine adhesive is a non-hygroscopic adhesive.

Referring to FIG. 3, where like numbers refer to like parts, to obviate the aforedescribed problem, the improved moisture proof thermally actuated binding tape of the present invention, designated generally by the numeral 45, utilizes a non-hygroscopic adhesive 60 having a very low moisture absorbing capacity for the stripe 14 of spine adhesive. Non-hygroscopic adhesive 60 absorbs approximately 1/5 the moisture as the aforementioned prior art spine adhesive 13, effectively preventing the accumulation of moisture in the adhesive during storage or exposure to high humidity environments. One suitable non-hygroscopic adhesive is adhesive formulation TPX-12-576 of Henkel Corporation, LaGrange, Il.

Criteria for an acceptable non-hygroscopic adhesive for the invention is found in APPENDIX A, "Xerox Purchasing Specification" on the subject of "Adhesive-Polyamide, Hot Melt" As shown in the afore-mentioned Purchasing Specification, under "Property Requirements" (Section 4), the spine adhesive 60 specified for stripe 14 additionally requires a very low, i.e., 0.2% maximum moisture content when initially packaged. One adhesive meeting this requirement is the aforecited Henkel TPX-12-576 adhesive.

Additionally, the use of non-hygroscopic adhesive 60 for central stripe 14 of binding tape 45 has enabled the thickness of the layer of adhesive 60 to be reduced to approximately 0.019 inches. This provides faster heating during the binding process and a reduction in the amount, and hence the cost, of the adhesive used.

In use, the loose pages comprising the book are placed, spine edge first on binding tape 45. Sides 18 are turned upwardly to bring the adhesive 21 comprising side stripes 19 into contact with the outside pages or covers of the book 15. Heat and pressure may then be applied, either simultaneously or in stages, to the bottom and sides of backing strip 12 to activate, i.e., melt, the adhesives 60, 21 and bind the pages of book 15 to one another and to backing strip 12.

The application of heat and pressure to the bottom of backing strip 12 activates the spine adhesive 60, the relatively large quantity of adhesive that comprises the stripe 14 of adhesive flowing or wicking between and among the edges of the book pages and being absorbed intimately therewith to bond the pages together to one another and to backing strip 12. The application of heat and pressure to sides 18 of strip 12 activates the adhesive 21 to establish a tight bond between the sides 18 of strip 12 and the outer pages or covers of book 15. This prevents sides 18 from unfolding away from the outer pages or covers of book 15 when the source of heat and pressure is removed and the binding is completed.

Because of the non-hygroscopic nature of spine adhesive 60, little if any moisture accumulates during shipment and storage of the tape 10 prior to use. As a result, small if any quantities of steam are generated during the binding process, resulting in an improved binding. And since the use of non-hygroscopic adhesive 60 permits the thickness of stripe 14 to be reduced, a reduction in the amount of adhesive used is achieved as well.

Use of low tack adhesive 21 for side stripes 19 reduces the amount of heat or thermal energy required to activate adhesive 21 which in turn reduces or eliminates any steam that might be generated from moisture accumulated by adhesive 2. And, any steam generated as a result of moisture in backing strip 12 is prevented from passing into the adhesives 60, 21 by the moisture barrier 50, and instead remains trapped within the backing strip.

While the invention has been described with reference to the structure disclosed, it is not confined to the details set forth, but is intended to cover such modifications or changes as may come within the scope of the following claims.

APPENDIX A
XEROX
PURCHASING SPECIFICATION
ADHESIVE - POLYAMIDE, HOT MELT

SCOPE

This specification covers a translucent, light amber colored, solid, thermoplastic polyamide hot melt adhesive for non-structural, non-load bearing, bonding, bending and sealant applications.

QUALIFIED SUPPLIER(S) AND FORMULATION(S)

(See "PURCHASE ONLY FROM" INFORMATION, AND SUPPLEMENTARY INFORMATION.)

PROPERTY REQUIREMENTS

| Physical (Unbonded Condition) | Test Method | Required |
|---|---|---|
| *Color | Visual | Translucent, Light Amber |

-continued

APPENDIX A
XEROX
PURCHASING SPECIFICATION
ADHESIVE - POLYAMIDE, HOT MELT

| | | |
|---|---|---|
| *Softening Point Range, C. (F.) | ASTM E28 Ring and Ball | 132-145 (270-293) |
| Density @ 23 C. (73 F.), g/cm$^3$ | ASTM D792 | 0.98 |
| Apparent Viscosity Range, cP | ASTM D3236(1) | |
| 171 C. (340 F.) | | 24,900 ± 3700 |
| 182 C. (360 F.) | | 15,700 ± 2300 |
| 193 C. (380 F.) | | 9,700 ± 1400 |
| 204 C. (400 F.) | | 6,200 ± 600 |
| *210 C. (410 F.) | | 5,000 ± 1000 |
| 216 C. (420 F.) | | 3,300 ± 300 |
| 227 C. (440 F.) | | 2,350 ± 250 |
| Flash Point, C. (F.), min. | ASTM D92 Cleveland Open Cup | 321 (610) |
| *Moisture Content at Packaging | | 2% Maximum |

Lot or Batch Acceptance Tests - The Acceptance Tests shall consist of the following requirements detailed in Paragraph 4.0 (Marked with *):

Unbonded Condition

Color
Softening Point
Apparent Viscosity at 210 C. (410 F.)
Moisture Content at Initial Packaging

"PURCHASE ONLY FROM" INFORMATION

| Qualified Supplier(s) | Qualified Formulation(s) |
|---|---|
| Henkel Corporation<br>5325 South 9th Avenue<br>LaGrange, IL 60525-3602 | TPX-12-576 |

SUPPLEMENTARY INFORMATION

Usage

This material is intended initially for use on 5090F Bookbinding Tape, as the spine adhesive.
The spine adhesive bonds the pages of the book and the binding tape wrapper material together.
Excellent adhesion to standard copy paper and to the aluminum foil surface of the substrate is required.

We claim:

1. In a binding tape for application to the spine of a book to bind the pages together that comprise said book, said tape having a backing strip with at least one stripe of high tack hot melt adhesive on said tape and a layer of non-permeable moisture resistant barrier material between said backing strip and said adhesive stripe to prevent transfer of moisture in the form of steam from said backing strip to said adhesive stripe on application of heat to said tape, application of heat to said tape actuating said adhesive to form a bond between said tape and said book spine, the improvement comprising:

said stripe of high tack hot melt adhesive comprising a substantially non-hygroscopic adhesive material to obviate the accumulation of moisture by said adhesive material and the generation of undesirable steam on application of heat to said tape during binding, said non-hygroscopic adhesive material maintaining a moisture content of substantially less than 3% when being stored.

2. The binding tape according to claim 1 in which said adhesive comprises an adhesive material having a maximum moisture content when packaged of 0.2% or less.

3. The binding tape according to claim 2 including a pair of adhesive stripes on said backing strip on each side of said first adhesive stripe, said second adhesive stripes being composed of a relatively low tack adhesive material whereby to reduce the amount of heat required to actuate said second adhesive to a level below that at which steam is generated from any moisture present in said second adhesive.

4. A moisture proof thermally activated binding tape for use in binding pages together to form a book, comprising in combination:

a) a backing strip, said backing strip being composed of paper;

b) a relatively thick first stripe of heat activated adhesive on said tape, said first adhesive stripe extending longitudinally of said backing strip substantially along the center thereof, said first adhesive stripe having a width less than the width of said backing strip whereby side portions of said backing strip extend along each side of said first adhesive stripe;

said first adhesive stripe comprising a substantially non-hygroscopic adhesive material to substantially eliminate accumulation of moisture in said first adhesive stripe and the generation of steam during binding, said non-hygroscopic adhesive material maintaining a moisture content of substantially less than 3% when being stored;

c) a relatively thin second stripe of heat activated adhesive on said side portions;

said second adhesive stripe comprising a low tack adhesive material requiring lower temperatures for activation whereby to inhibit generation of steam from moisture present in said second adhesive stripe during binding; and d) a relatively thin moisture barrier layer between said backing strip and said first and second adhesive stripes to prevent the passage of steam from moisture in said backing strip to said first and second adhesive stripes when said binding tape is thermally activated.

5. An improved moisture proof thermally activated binding tape for use in binding pages together to form a book, comprising the combination of:

a) a backing strip of paper;

b) a moisture impervious barrier on one side of said backing strip;

c) a relatively thick stripe of spine adhesive on said moisture barrier, said spine adhesive comprising a high tack heat activated adhesive extending longitudinally of said backing strip substantially along the center thereof, said spine adhesive having a width less than the width of said backing strip whereby uncovered side portions of said moisture barrier extend along each side of said spine adhesive stripe;

d) relatively thin stripes of heat activated low tack adhesive on said uncovered moisture barrier sides, the low heat required to activate said thin stripes of said low tack adhesive inhibiting generation of steam from moisture in said low tack adhesive;

e) said moisture impervious barrier preventing passage of moisture in the form of steam from said backing strip into said spine adhesive and said low tack adhesive during said thermal binding process;

f) said spine adhesive being comprised of a reduced hygroscopic adhesive material having reduced moisture absorption so as to reduce the amount of moisture absorbed by said spine adhesive prior to use of said binding tape whereby on application of heat to said binding tape when binding pages together, generation of steam in said spine adhesive is reduced and a moisture content of substantially less than 3% is maintained during storage of said reduced hygroscopic adhesive material.

* * * * *